US008043113B2

(12) United States Patent
Niitsu

(10) Patent No.: US 8,043,113 B2
(45) Date of Patent: Oct. 25, 2011

(54) RELAY CONNECTOR FOR FLEXIBLE CABLES

(75) Inventor: Toshihiro Niitsu, Machid (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/440,736

(22) PCT Filed: Sep. 11, 2007

(86) PCT No.: PCT/US2007/019693

§ 371 (c)(1),
(2), (4) Date: Nov. 2, 2009

(87) PCT Pub. No.: WO2008/033318

PCT Pub. Date: Mar. 20, 2008

(65) Prior Publication Data

US 2010/0075541 A1 Mar. 25, 2010

(30) Foreign Application Priority Data

Sep. 11, 2006 (JP) ..... 2006-245749

(51) Int. Cl.
*H01R 12/77* (2011.01)

(52) U.S. Cl. ..... 439/495

(58) Field of Classification Search ..... 439/67, 439/492, 493, 495, 260
See application file for complete search history.

(56) References Cited

U.S. PATENT DOCUMENTS 7,862,358 B2 * 1/2011 Nishimatsu et al. ..... 439/260
7,887,351 B2 * 2/2011 Wang et al. ..... 439/260

FOREIGN PATENT DOCUMENTS

DE 100 65 972 A1 7/2002
EP 1 152 491 A2 11/2001
EP 1 204 172 A1 12/2003
JP 2002-170613 6/2002

OTHER PUBLICATIONS

International Search Report for PCT/US2007/019693.

* cited by examiner

*Primary Examiner* — Khiem Nguyen
(74) *Attorney, Agent, or Firm* — Timothy M. Morella

(57) ABSTRACT

A connector (1) comprises a housing (11) including a base plate portion (12) facing one surface of a pair of flat cables (101), and a plurality of terminals (51) for contacting conductive wires of the flat cables, wherein the base plate portion includes a plurality of hook members (31) disposed side by side with the terminals for engaging with engaging holes (112) of the flat cable.

15 Claims, 11 Drawing Sheets

RELAY CONNECTOR FOR FLEXIBLE CABLES

BACKGROUND OF THE INVENTION

The present invention relates to a connector.

Conventionally, a connector for connecting flexible flat cables referred to as flexible circuit boards, flexible flat cables, or the like, is known and described in Japanese Patent Application Laid-Open Publication (Kokai) No. 2002-170613. FIG. 18 is a perspective view of such a conventional connector.

Reference numeral 803 designates a flat cable which includes a base film made of an insulating material such as a synthetic resin or the like, and a plurality of conductive wires 804 made of a conductive material such as metal or the like, and supported by the base film. The coating of the conductive wires 804 is removed in the end portion of the flat cable 803, and the conductive wires 804 are exposed on one surface, the lower surface in FIG. 8. Slits 805 are formed in the end portion of the flat cable 803 between adjacent conductive wires 804 and extend through the base film.

Numeral 800 designates a slider member fitted in a connector housing (not shown) and the slider member includes a flat tongue portion 801 to be inserted in a horizontally elongated opening formed in the front surface of the connector housing. Projections 802 that engaged the slits 805 of the flat cable 803 are formed in the lower surface of the tongue 801.

When connecting the flat cable 803, the tongue 801 is inserted in the opening after the end of the flat cable 803 is inserted in the opening of the connector housing, so the tongue 801 fits in the opening. The tongue 801 is inserted horizontally and the end portion of the flat cable 803 is pressed downward by the tongue 801 and the conductive wires 804 are pressed against terminals disposed in the opening of the connector housing to connect them together.

Each of the projections 802 of the tongue 801 engages a corresponding slit 805 of the flat cable 803 so that the end of the flat cable 803 is maintained in the opening of the connector housing. These slits and projections keep the conductive wires 804 and corresponding terminals in contact with each other.

SUMMARY OF THE INVENTION

However, in the above-mentioned conventional connector, the reaction force occurs when the wires 804 are pressed against the terminals is received at opposite ends of the opening of the connector housing, and the width of the opening may not be increased very much, and it is difficult to increase the number of terminals, that is, to achieve multipolarity of the connector. When the tongue 901 is inserted in the horizontal opening, the end of the flat cable 803 is pressed downward against the terminals by the tongue 801. However, the upward reaction force from the terminals is transferred to the ceiling of the opening by the tongue 801. If the width of the opening is increased to increase the number of the terminals, the ceiling near the center of the opening will bulge out and be deformed. The ceiling may be prevented from being deformed if the wall thickness of the ceiling is made thicker, thereby increasing the size of the connector.

It is necessary to insert the end of the flat cable 803 and the tongue 801 of the slider member 800 in the opening of the connector housing, the work for connecting the flat cable 803 is complicated.

It is an object of the present invention to solve the problems with the above-described conventional connector and provide a connector, in which hook members for engaging holes formed in a flat cable are disposed side by side with terminals, whereby the flat cable can be secured by cooperation of an elastic force exerted by the terminals and the hook members, and the flat cable can be easily and surely connected despite the connector having a simple structure, and a force is not applied to the center of the housing opening so that the housing can be prevented from being deformed, and the width of the housing can be increased to achieve multipolarity in the connector.

For the above reasons, a connector, according to the present invention, comprises a housing including a base plate portion facing one surface of a pair of flat cables, and a plurality of terminals for contacting conductive wires of the flat cables, wherein the base plate portion includes a plurality of hook members disposed side by side with the terminals for engaging with engaging holes of the flat cable.

A connector, according to another aspect of the present invention, includes a housing including a base plate portion facing one surface of a pair of flat cables and a plurality of terminals extending longitudinally in the housing with an approximately symmetric shape with respect to a longitudinal axis at the center of the connector for contacting conductive wires of the flat cables, and wherein the base plate portion includes a plurality of hook members disposed side-by-side with the terminals for engaging holes of the flat cables.

In the connector according to a further aspect of the present invention, the shape of the housing is shaped such that it extends in the longitudinal direction of the housing and has an approximately axially symmetrical shape with respect to a central longitudinal axis of the connector.

In the connector according to still further aspect of the present invention, the terminal further includes a base portion fixed to the base plate portion, an inclined portion connected to the base portion and disposed farther away from the base plate portion as a position thereof changes toward a distal end thereof, and a contact portion connected to the inclined portion and brought into contact with the conductive wire of the flat cable, the terminals applying an urging force to the flat cable connected to the connector in a direction away from the base plate portion, and the hook members engage with the flat cable against the urging force of the terminals.

In the connector according to a still further aspect of the present invention, the hook members are disposed between adjacent terminals, or is disposed between the adjacent groups of the terminals.

In the connector according to a still further aspect of the present invention, the hook members extend over a range including at least the contact portion of the flat cable.

The connector according to a still further aspect of the present invention further includes an actuator provided in the housing such that the position of the actuator can be changed between a first position in which the cable can be inserted and a second position in which the inserted cable is covered, and where the actuator in its second position prevents the flat cable from moving away from the base plate portion.

According to the present invention, the connector is constituted such that the hook members for engaging holes formed in the flat cable are disposed side-by-side with the terminals. Thereby, the flat cable can be secured by the cooperation of the elastic force exerted by the terminals and the hook members. As a result, the flat cable can be easily and surely connected to the connector despite the connector having the simple structure, a force may not be concentrated on or applied to the center portion of the housing in the width direction, the housing can be prevented from being deformed, and the width of the housing can be increased to achieve multipolarity in the connector.

DESCRIPTION OF TEE PREFERRED EMBODIMENTS

Figure 1:
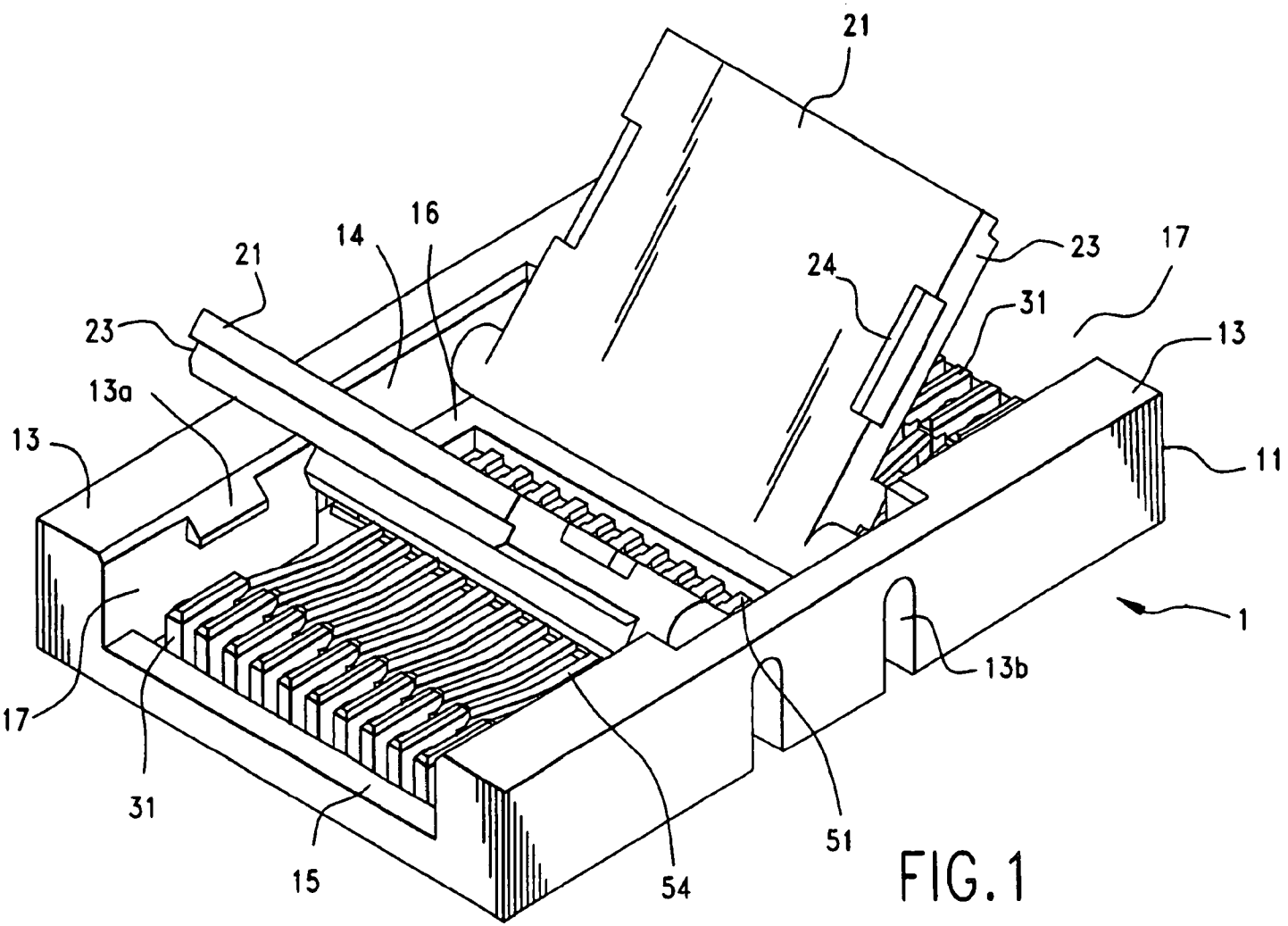
FIG. 1 is a perspective view of a connector according to the first embodiment of the present invention.
Figure 2:
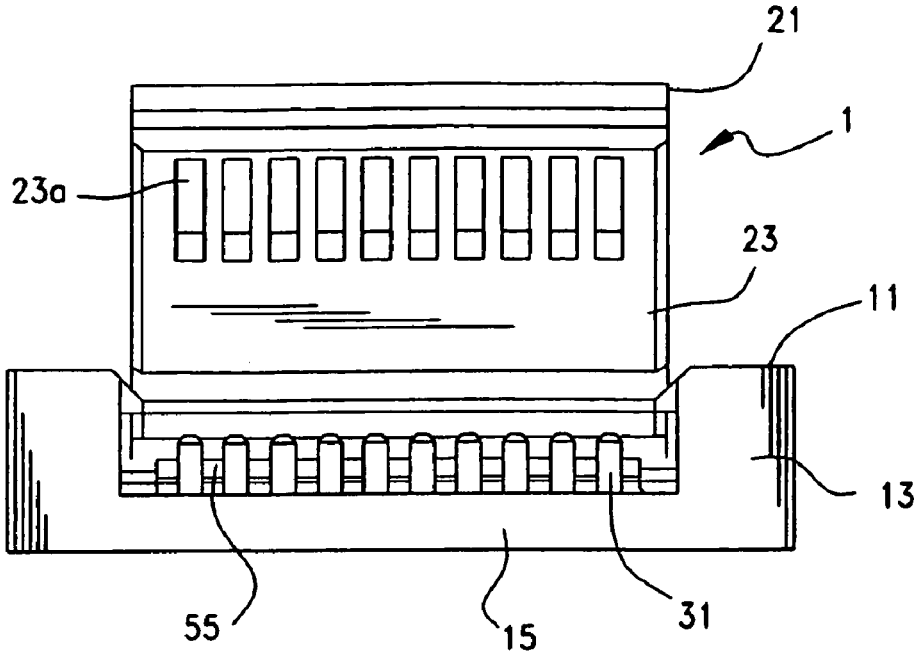
FIG. 2 is a side view of the connector according to the first embodiment of the present invention.
Figure 3:
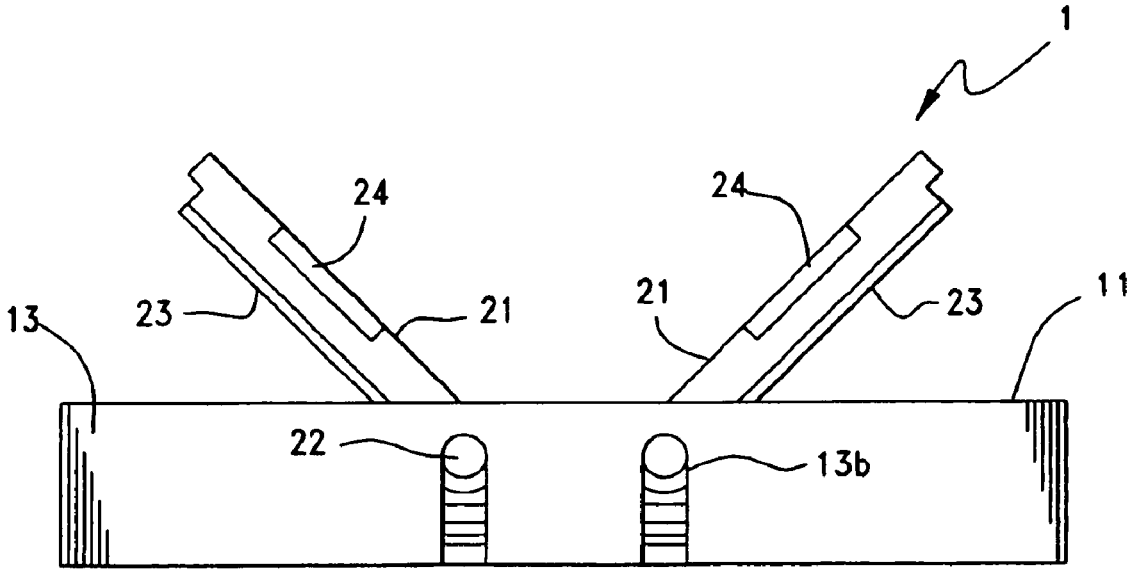
FIG. 3 is a front view of the connector according to the first embodiment of the present invention.
Figure 4:
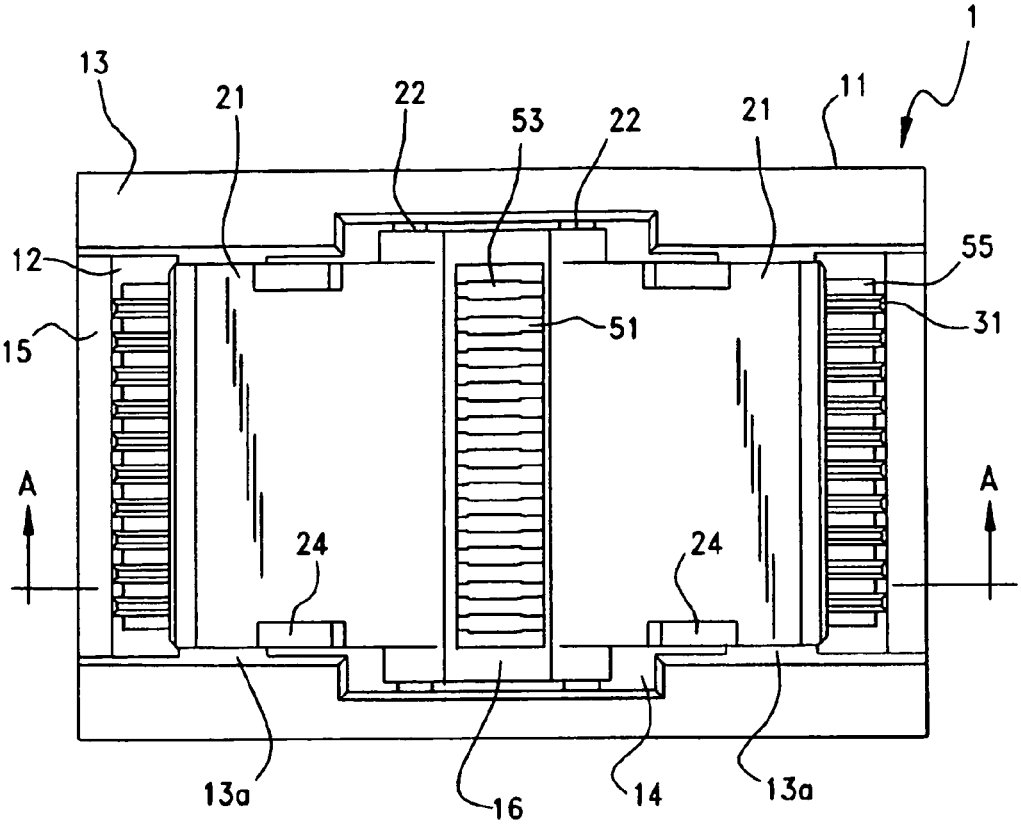
FIG. 4 is a plan view of the connector according to the first embodiment of the present invention.

In the Figures, reference numeral 1 designates a connector as a relay connector in the first embodiment of the present invention, and the connector 1 is used for mutually and electrically connecting a pair of flat cables 101, which will be described later. The flat cable 101 is a flat plate-like flexible cable referred to as a flexible printed circuit (FPC), a flexible flat cable (FFC), or the like, but any type of cable may be used as long as it is a flat cable including conductive wires.

In this embodiment, representations of directions such as up, down, left, right, front, rear, and the like, used for explaining the structure and movement of each part of the connector 1, are not absolute, but relative. These representations are appropriate when the connector 1 is in the position shown in the figures. If the position of the connector 1 changes, however, it is assumed that these representations are to be changed according to the change of the position of connector 1.

The connector 1 has an insulative housing 11 and a pair of actuators 21 rotatably mounted to the housing 11.

The actuator 21 is also a flat plate-like member. The actuator 21 may be made of any type of material and molded of according to any molding method. Each actuator 21 is attached to the housing 11 so that its position can be changed, an open position (a first position) and a closed position (a second position). FIGS. 1 to 5 illustrate the state in which the actuator(s) 21 are open.

The housing 11 includes a base plate portion 12 in the form of a rectangular plate member and facing one surface of the flat cable 101 and parallel side walls 13 respectively disposed on opposite sides of the base plate 12 and extending longitudinally in the housing to threshold portions 15 disposed upright on opposite ends of the base plate portion 12 which connect ends of the side walls 13. The base plate 12, side walls 13 and the threshold portions 15 are shown integrally formed. An accommodation space 17 which is open in the top side opposite to the base plate 12, is defined by the base plate 12, the side walls 13, and the threshold portions 15. The threshold portion 15 is formed thinner and lower than the side walls 13. Furthermore, concave engagement portions 14 are formed in the center of the inner surfaces of the side walls 13.

Terminals 51 extend longitudinally in the housing 11, and are made of an elastic conductive material like metal such as phosphor bronze, and have an axially symmetrical shape with respect to a longitudinal axis at the center of the connector. (FIG. 5) A base portion 53 is located in the center of the terminal 51 and is held by a terminal holding member 16 made of an insulating material. It is preferable that the terminal holding member 16 and housing is formed of a high heat-resistant resin such as LCP. The terminals 51 are arranged parallel to each other and are integrally held by the terminal holding member 16. The number and the distance of the terminals 51 may be appropriately changed according to the number and the pitch of conductive wires (not shown) of the flat cable 101.

Figure 5:
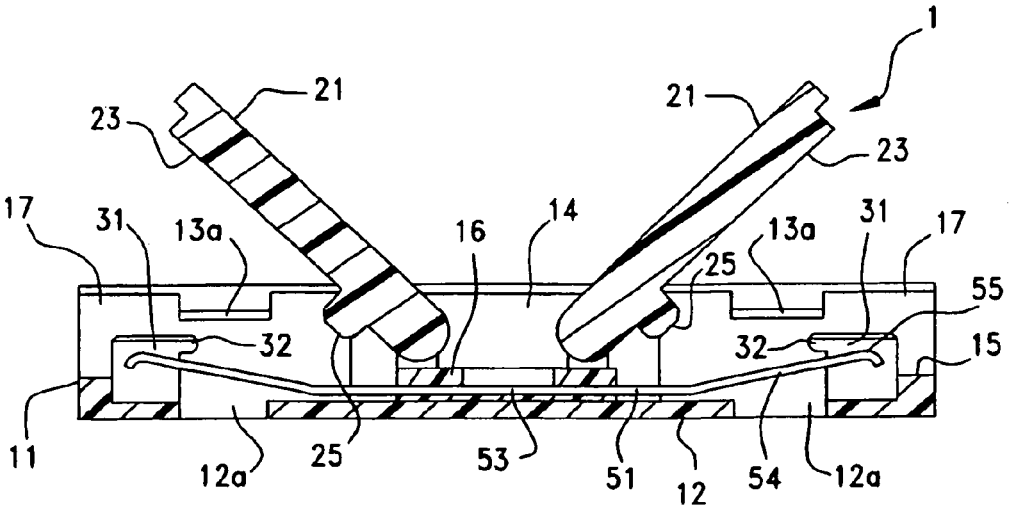
FIG. 5 is a cross-sectional view of the connector according to the first embodiment of the present invention, taken along the line A-A in FIG. 4.

As illustrated in FIG. 5, the terminal 51 projects from the terminal holding member 16 and extends in two directions, to the right and left of the terminal holding member 16 (toward opposite ends of the housing 11 by approximately the same length). Portions 54 of the terminal base portion 53 adjacent to the ends thereof project from the terminal holding member 16, and are connected to the ends of the base portion 53 and to terminal end portions 55. The portions of the terminals 51 projecting to the right and left are mutually connected by the common base portion 53 in the terminal holding member 16.

The terminals 51 are received in the accommodating space 17, when the terminal holding member 16 is mounted on the housing 11. The base portion 53 extends parallel to the upper surface of the base plate portion 12; and the terminal inclined portion 54 is inclined with respect to the upper surface of the base plate portion 12 such that the closer the position thereof is to the free end thereof, the more the inclined portions 54 rise, and the end portion 55 is curved so that the end thereof faces downward. The terminals 51 are inclined cantilevered beams, with one end held by the terminal holding member 16 and the free end 55 disposed farther away from the upper surface of the base plate 12. The terminal holding member 16 is a thick plate-like member of approximately rectangular shape, and opposing ends of the terminal holding member 16 are fitted in and secured the concave engagement portions 14 so that the positioning of the terminal holding member 16 and the terminals 51 relative to the housing 11 is maintained.

In this embodiment, the housing 11 includes a plurality of hook members 31 projecting upward from the base plate 12, and engaging holes 112 formed in the flat cable 101, and are integrally formed with the base plate 12. In the illustrated embodiment, each of the hook members 31 is also a plate-like member having an approximately rectangular shape and is disposed so that the hook member 31 is positioned between the end portions 55 of adjacent terminals 51. The hook members 31 are arranged alternately with the end portions 55 of the terminals 51 and form a row extending widthwise with respect to the base plate portion 12. The lower side surfaces of the hook members 31 arranged on the side opposite to the center of the housing 11 are connected to the threshold portion 15, and the lower ends of the side surfaces of the hook members 31 arranged on the side of the center of the housing 11 are adjacent to an opening 12*a* formed in the base plate 12.

Engaging projections 32 project toward the center of the housing 11, i.e., toward the leading end of the flat cable 101 and are integrally formed with the upper ends of the hook members 31. These projections 32 engage with the upper surface of the flat cable 101 to restrict the upward displacement of the flat cable 101 to prevent the holes 112 and the hook members 31 from being disengaged. The flat cable 101 downwardly presses the end portions 55 of the terminals 51 positioned between the adjacent hook members 31, and receives an upward reaction force from the terminals 51 so the flat cable 101 is sandwiched and held from above and below by the engaging projections 32 of the hook members 31 and the terminal end portions 55 and the connection is maintained.

Each of the hook members 31 extends over the range including the position of the end portion 55 of the terminal 51 with respect to the connection direction of the flat cable 101. The distance in the connection direction of the flat cable 101 between the point of action of the upward force which the flat cable 101 receives from the terminal end portions 55 and the point of action of the downward force which the flat cable 101 receives from the engaging projections 32 of the hook members 31 can be approximated down to zero. The flat cable 101 is pinched by receiving the upward and downward forces applied from the terminals 51 and the hook members 31 at approximately the same region in the connection direction of the flat cable 101. The flat cable 101 is reliably sandwiched and held, without being deformed.

The actuator 21 is a thick member and has a body portion 23 handled by an operator with fingers or the like, and a rotation shaft 22 projecting from the opposite sides near one end of the body portion 23. The rotation shaft 22 is inserted in a shaft-supporting slot 13*b* formed in a portion in each of the side walls 13 near where the engagement concave portions 14 exist, and is rotatably supported. The actuator 11 can change its position between the open and closed positions by rotating the actuator 11 around the rotation shaft 22.

The actuator 21 includes, on a lower surface of the body portion 23, hook accommodating recess portions 23*a* for accommodating the upper ends of the hook members 31 when the actuator 21 is closed. Also, it has a cable regulation projection 25 for regulating the position of the leading end of the flat cable 101. The hook accommodating recess portions 23*a* correspond to the hook members 31, respectively. The cable regulation projection 25 extends widthwise and is brought into contact with the leading end of the flat cable 101. Lock recess portions 24 are formed in both sides of the body portion 23 and they engage with lock projections 13*a* projecting from inner surfaces of the side walls 13 on the opposite sides to lock the actuator 21, so that the actuator 21 is prevented from moving to the open position.

Figure 6:
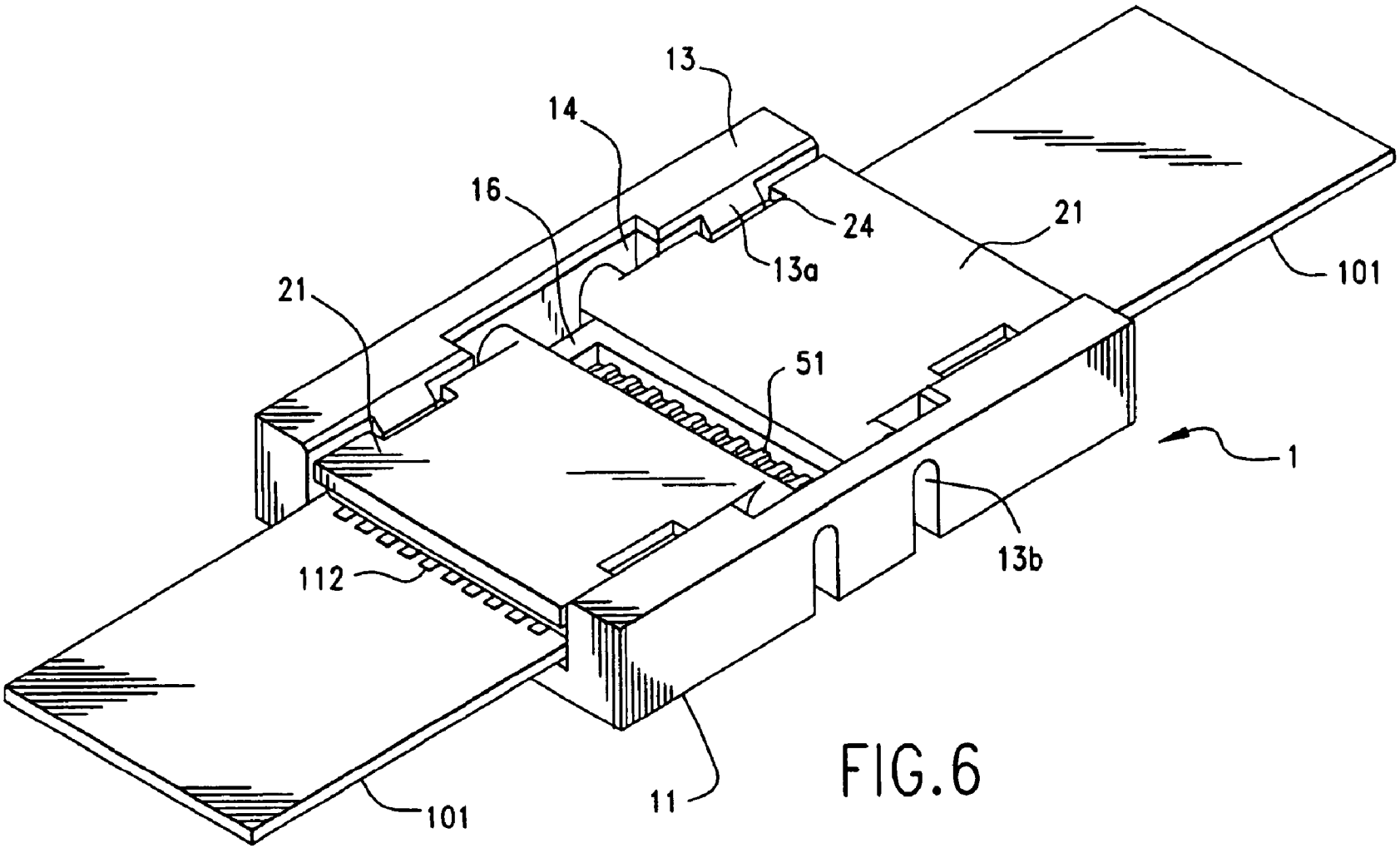
FIG. 6 is a perspective view of the connector according to the first embodiment of the present invention, in the state in which flat cables are connected thereto.

The flat cable 101 includes a base plate which is an insulating thin-plate member and a plurality of conductive wires (not shown) disposed in one surface of the base plate portion, the lower surface in FIG. 6. The conductive wires are foil-like linear members made of conductive metal such as copper, for instance, and are disposed in parallel at an arbitrary pitch.

The surfaces of the conductive wires on the side opposite to the base plate portion are covered by an insulating protective film (not shown), and the protective film is removed only in the predetermined area adjacent to the free end of the flat cable 101 so that the conductive wires are exposed.

Slit-like holes 112 extend longitudinally in the flat cable 101. Each of the holes 112 is approximately rectangular, and has the width approximately corresponding to the thickness of the hook member 31 and the length approximately corresponding to the length of the hook member 31. The length of the hole 112 is preferably equal to the dimension of the upper end portion of the hook member 31 in the connection direction of the flat cable 101. Each of the holes 112 is disposed between adjacent conductive wires of the cable. The engaging holes 112 are disposed alternately with the conductive wires to form a row extending widthwise. The shape of each of the hole 112 is not limited as long as it can be engaged with the hook member 31; the shape of the holes 112 may be round or elliptic. The engaging holes are formed in the flat cable 101 by subjecting the flat cable 101 to masking in the similar shapes as the engaging holes 112 to form holes by using a laser, plasma, or the like. As a further example, the holes may be formed by press.

When connecting the flat cable 101 to the connector 1, first the leading end of the flat cable 101 is inserted between the actuator 21 and the base plate portion 12 of the housing 11, and is positioned so that the conductive wires face the base plate portion 12.

Figure 7:
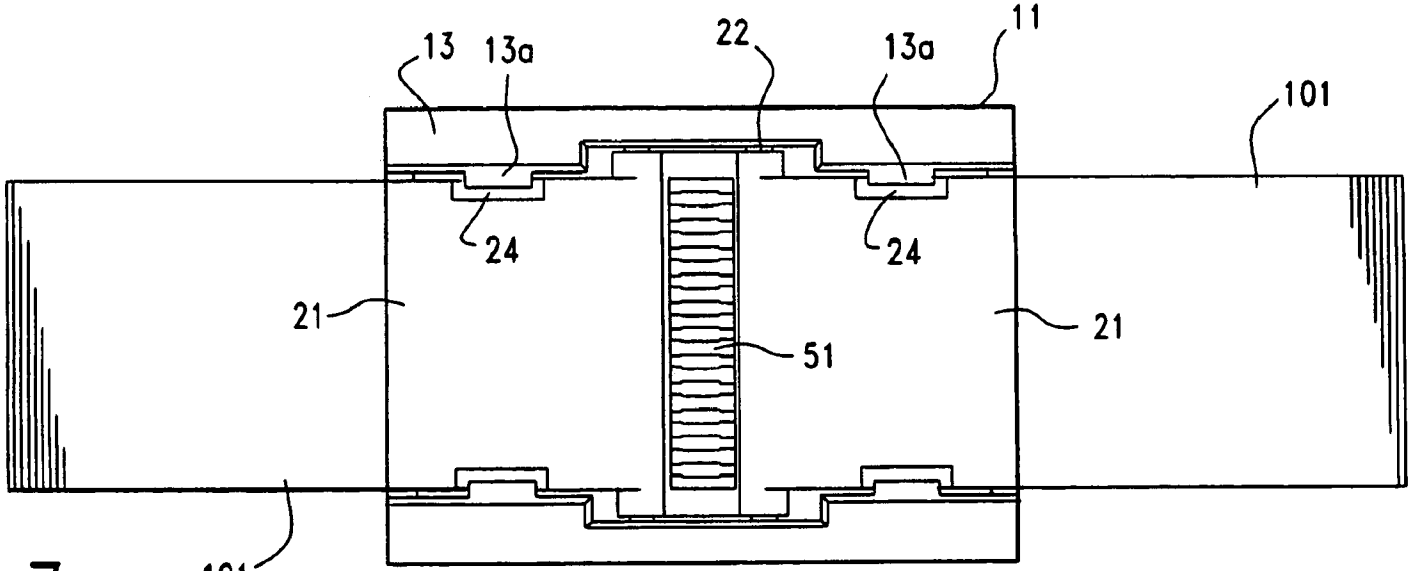
FIG. 7 is a plan view of the connector according to the first embodiment of the present invention, in the state in which the flat cables are connected thereto.
Figure 8:
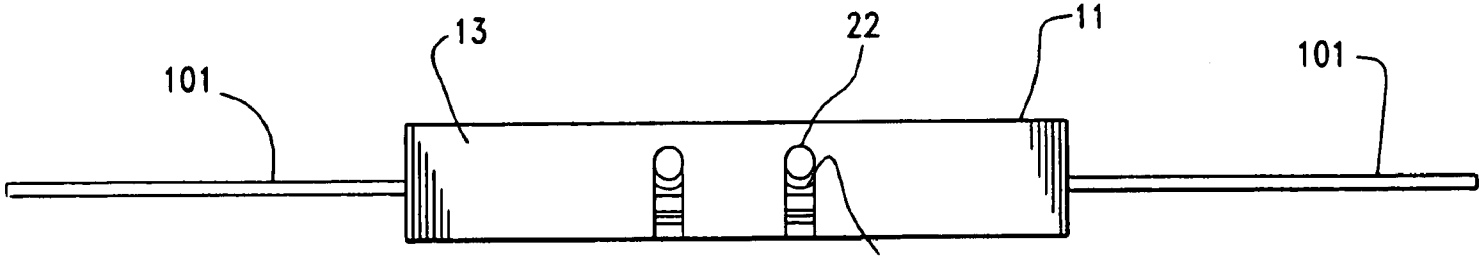
FIG. 8 is a front view of the connector according to the first embodiment of the present invention, in the state in which the flat cables are connected thereto.

In FIGS. 7 and 8, the flat cable 101 to be connected to the right portion of the connector 1 is positioned above the right portions of the terminals 51 the leading end thereof faces to the left, and each of the holes 112 is positioned immediately above each of the corresponding hook members 31 of the housing 11. Similarly, the flat cable 101 to be connected to the left portion of the connector 1 is positioned above the left portions of the terminals 51 such that the longitudinal direction of the flat cable 101 is horizontal and the leading end thereof faces to the right.

The flat cable 101 is moved down so the hook members 31 are inserted in the corresponding holes 112. In this case, because the holes 112 are between adjacent conductive wires and the hook members 31 are disposed between the end portions 55 of the adjacent terminals 51, the positioning of each conductive wire of the flat cable 101 and the end portion 55 of each terminal 51 is automatically performed, by bringing the hole 112 and the hook member 31 into engagement with each other.

When the flat cable 101 is moved downward and the holes 112 are engaged with the hook members 31, the conductive wires exposed on the lower surface of the cable 101 contact the end portions 55 of the terminals 51 and press the end portions 55 downward. Here, since the terminals 51 are made of an elastic material, the terminals 51 are resiliently deformed by the conductive wires. The end portions 55 press up against the conductive wires by virtue of their elasticity. The flat cable 101 receives an upward urging force from the terminal end portions 55.

When the height of the upper surface of the flat cable 101 is equal to the height of the lower surface of the engaging projections 32 of the hook members 31, the flat cable 101 is moved away from the center of the housing 11. Then, the engaging projections 32 projecting in the upper ends of the hook members 31 toward the center of the housing 11 engages the upper surfaces of the flat cable 101. The upward displacement of the flat cable 101 is regulated by the engaging projections 32 and the holes 112 and the hook members 31 is prevented from being canceled.

The flat cable 101 is sandwiched and held from above and below by the engaging projections 32 of the hook members 31 and the terminal end portions 55. The end portion 55 of each terminal 51 is pressed against the corresponding conductive wire due to elasticity of the terminal 51 itself; and is electrically connected to the conductive wire. The flat cable 101 is brought into the state in which it is connected to the connector 1.

Subsequently, the position of the actuators 21 is changed from open to closed by rotating the actuators 21 around their shafts 22 to achieve that shown in FIGS. 6 to 8. The upper surface of the flat cable 101 near the leading end portion thereof is covered by the actuators 21 and the lower surface of the actuator body portion 23 contacts the upper surface of the flat cable 101. The upper end portions of the hook members 31 project upward from the holes 112 of the flat cable 101 and are accommodated in the hook accommodating recess portions 23*a* formed in the actuator body portion 23. When the actuators 21 are closed, because the lock recess portions 24 of the body portion 23 are engaged with the lock projections 13*a* of the housing 11 to lock the actuators 21, the position of the actuators 21 is prevented from being changed.

The upward displacement of the flat cable 101 is also regulated by the body portion 23 and the disengagement of the holes 112 and the hook members 31 is prevented. The connection is maintained with more certainty. Even if an external force is applied to the flat cable 101, and the flat cable 101 moved upward in the connector 1, the flat cable 101 is not only being sandwiched between the engaging projections 32 of the hook members 31 and the end portions 55 of the terminals 51, but also the upward displacement is regulated by the actuator body portion 23.

The leading end of the flat cable 101 is brought into contact with the projection 25 of the actuator body portion 23 and the flat cable 101 is prevented from being disconnected. Therefore, the engagement between the engaging projections 32 with the upper surface of the flat cable 101 will not be undone.

The flat cable 101 is sandwiched and held by the hook members 31 and the terminals 51 which are arranged widthwise in the housing 11, prevents any force occurring by sandwiching the flat cable 101 to be concentrated on or applied to the center of the housing 11 widthwise and therefore the housing 11 can be prevented from being deformed.

Further, each of the hook members 31 exists over the range including the position of the end portions 55 of the terminal 51 with respect to the connection direction of the flat cable 101. Therefore, the flat cable 101 is sandwiched and held by receiving the upward and downward forces from the terminals 51 and the hook members 31 at approximately the same region with respect to the connection direction of the flat cable 101. Accordingly, the flat cable 101 will be stably sandwiched and held without being deformed.

In this embodiment, the present invention is explained in the case in which the actuators 21 are used, however, since the flat cable 101 can be sandwiched and held by the hook members 31 and the terminals 51 and the connecting state of the flat cable 101 to the connector 1 can be maintained, as described above, the actuators 21 may be omitted.

Also, in this embodiment, the present invention is explained in the case in which the hook members 31 are disposed fully in all gaps between the adjacent terminals 51, however, some of the hook members 31 can be omitted to broaden the distance between the adjacent hook members 31. That is, the hook members 31 can be dispose every plurality of, for instance, five terminals 51.

Further, in this embodiment, the present invention is explained in the case in which the engaging projections 32 projects toward the center of the housing 11, however, the engaging projections 32 can be arranged to project in the direction facing the side opposite to the center of the housing 11.

Further, in this embodiment, the connector 1 for connecting the flat cables 101 is described, in which the connector 1 has an approximately axisymmetric shape with respect to the straight line perpendicular to the longitudinal direction of the housing 11 in the center of the housing 11 in the longitudinal direction, however, the connector 1 may be constituted such that an arbitrary one half portion of the connector is connected to a substrate such as a conventionally known printed circuit board, or the like, and the flat cable 101 is connected to the substrate.

Next, the second embodiment of the present invention will be explained. As to the portions and parts of the structure which are the same as those in the first embodiment, they are given the same reference numerals and the explanation thereof will be omitted. In addition, as to the operation and the effect which are the same as those in the first embodiment, the explanation will be omitted.

Figure 9:
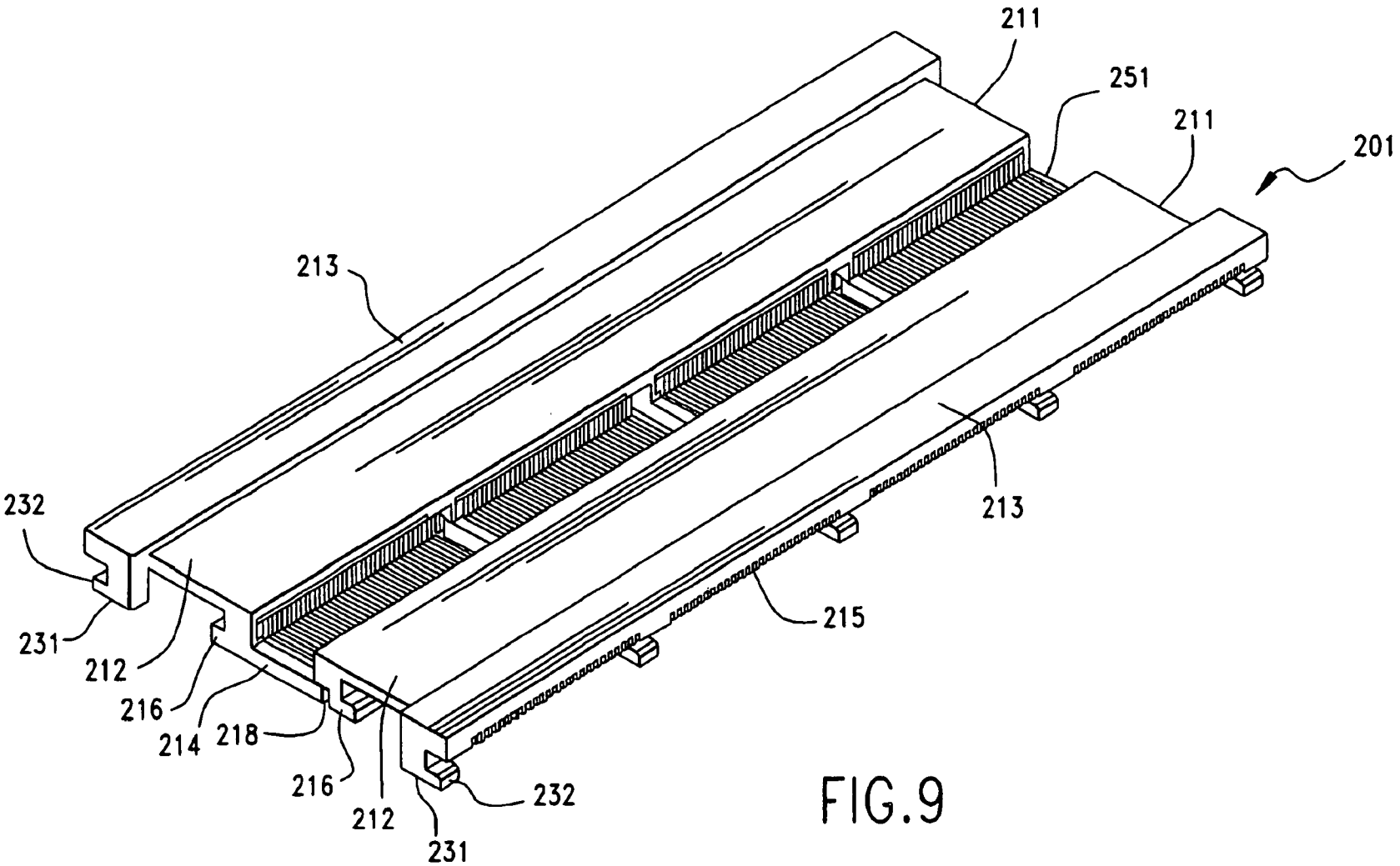
FIG. 9 is a perspective view of a connector according to the second embodiment of the present invention.
Figure 10:
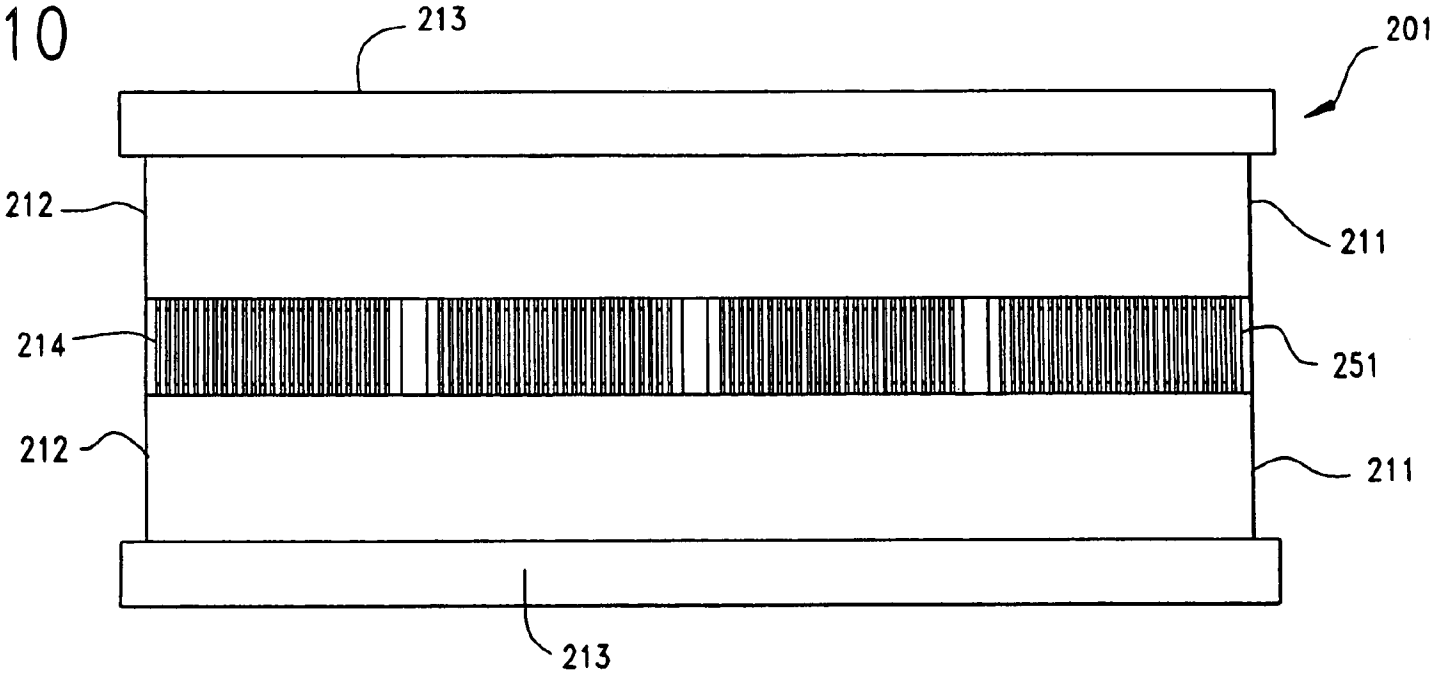
FIG. 10 is a plan view of the connector according to the second embodiment of the present invention.
Figure 11:
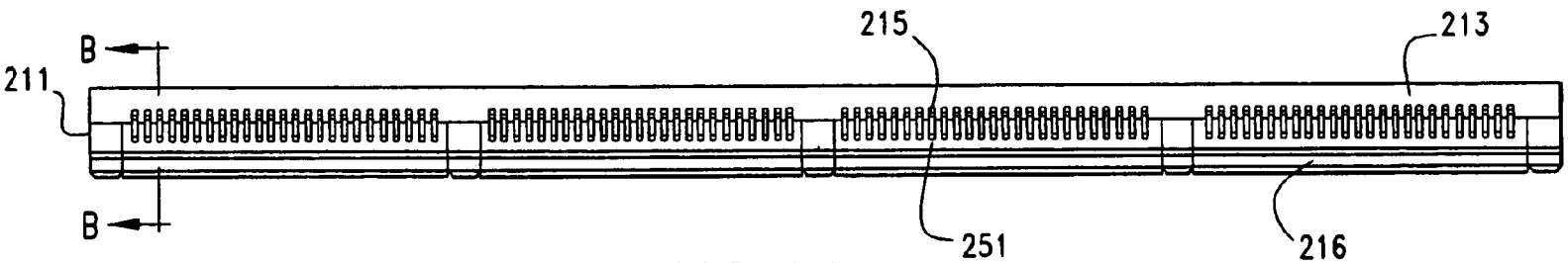
FIG. 11 is a front view of the connector according to the second embodiment of the present invention.
Figure 12:
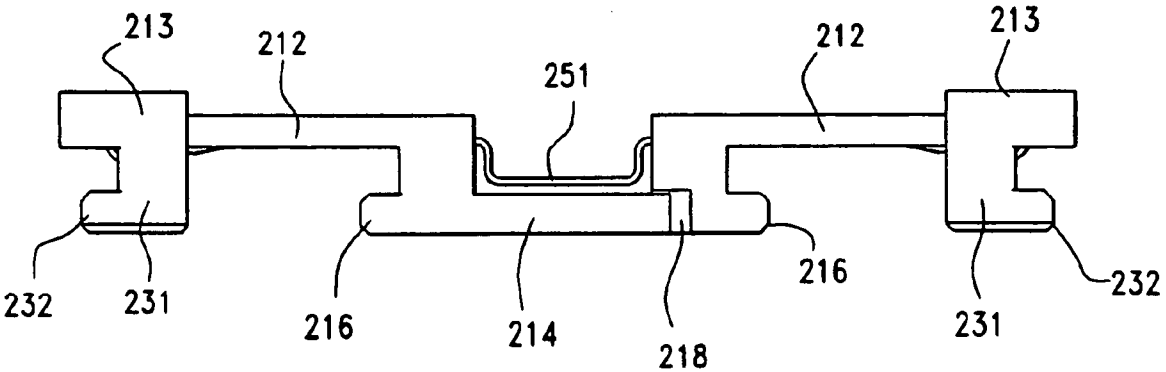
FIG. 12 is a side view of the connector according to the second embodiment of the present invention.
Figure 13:
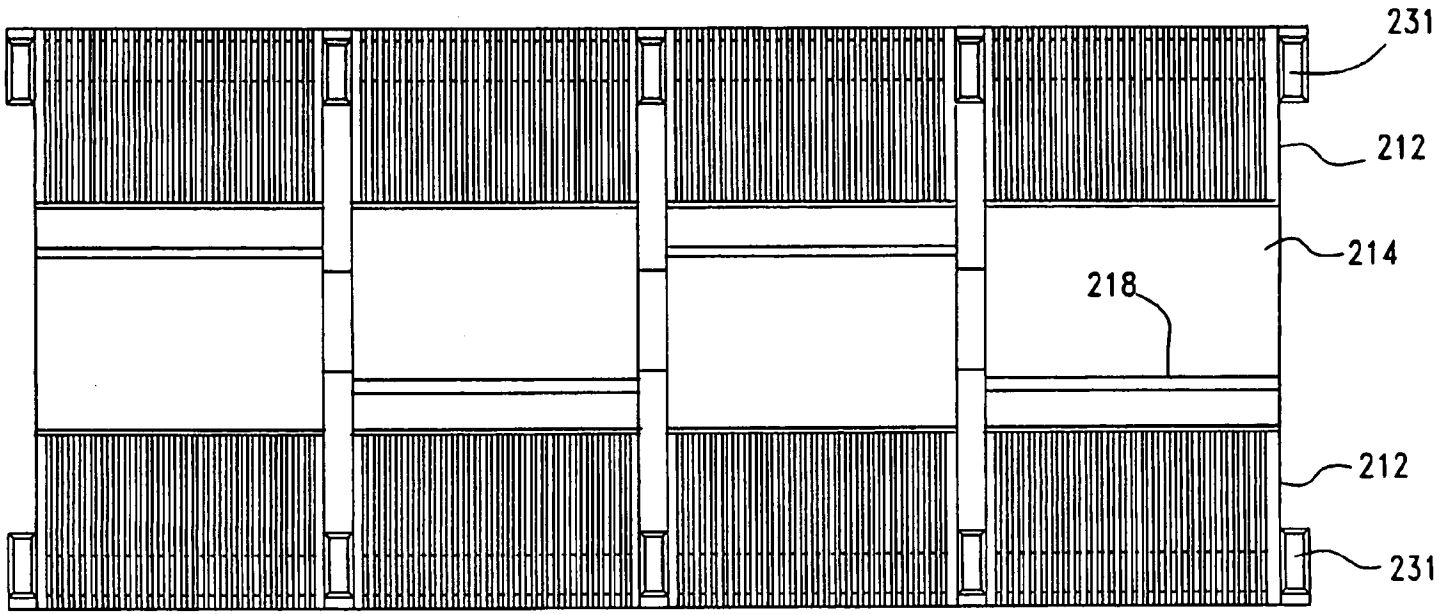
FIG. 13 is a bottom view of the connector according to the second embodiment of the present invention.
Figure 14:
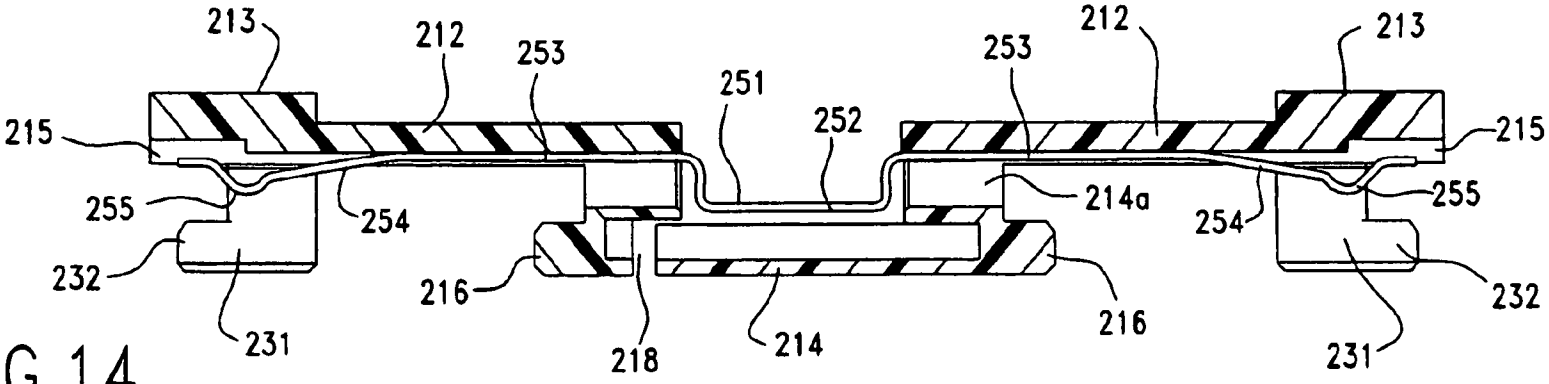
FIG. 14 is a cross-sectional view of the connector according to the second embodiment of the present invention, taken along the line B-B in FIG. 11.

FIG. 9 is a perspective view of a connector according to the second embodiment of the present invention. FIG. 10 is a plan view of the connector according to the second embodiment of the present invention. FIG. 11 is a front view of the connector according to the second embodiment of the present invention. FIG. 12 is a side view of the connector according to the second embodiment of the present invention. FIG. 13 is a bottom view of the connector according to the second embodiment of the present invention. FIG. 14 is a cross-sectional view of the connector according to the second embodiment of the present invention, taken along the line B-B in FIG. 11.

In the figures, reference numeral 201 designates a connector as a relay connector according to the second embodiment of the present invention, and the connector 201 is used for mutually and electrically connecting a pair of flat cables 301, which will be described later. Similar to the flat cable 101 in the first embodiment, the flat cable 301 is a flat flexible cable referred to as a flexible printed circuit, a flexible flat cable, or the like, but any type of cable may be used as long as it is a flat cable including conductive wires, or it may be a base plate-like cable not having flexibility.

In the second embodiment, representations of directions such as up, down, left, right, front, rear, and the like, used for explaining the structure and movement of each part of the connector 201, are not absolute, but relative. These representations are appropriate when the connector 201 is in the position shown in the figures. If the position of the connector 201 changes, however, it is assumed that these representations are to be changed according to the change of the position of connector 201.

Here, the connector 201 includes a pair of housings 211. Similar to the housing 11 according to the first embodiment, the housing 211 is a flat plate-like member which is integrally made of an insulating material such as a synthetic resin, for instance, the housing 211 is made of a plastic such as PBT, PC, LCP, PPS, polyamide, PEEK, or the like, and is integrally molded by a method such as injection molding. The housing 211 may be made of any material and molded by any molding method, however, it is preferable that the housing 211 is made of a high heat-resistant resin such as LCP. It is to be noted that the connector 201 and the housing 211 have, as a whole, a rectangular flat surface shape, but here, the direction along which the short side of the rectangle extends (vertical direction in FIGS. 10 and 13) is the connection direction of the flat cable 301, and is also the longitudinal direction of the connector 201 and the housing 211, and the direction along which the long side of the rectangle extends (transverse direction in FIGS. 10 and 13) is the width direction of the connector 201 and the housing 211.

The housing 211 includes a base plate portion 212 which is a rectangular plate-like member, and intermediate portions 214 connected to one side edge of the base plate portion 212. It is to be noted that the other side edge of the base plate portion 212 forms a thick portion 213 which is thicker than the other portions of the base plate portion 212. In addition, the intermediate portions 214 are connected to the side edge of the base plate portion 212 on the center side of the connector 201 to form a shoulder. It is to be noted that the base plate portion 212 and the intermediate portions 214 are integrally formed with each other. And, the intermediate portions 214 intermittently extend in the width direction of the connector 201 and are formed in a comb-like shape. That is, the housings 211 define groups for every arbitrary number of terminals 251 and one housing 211 has intermediate portions 214 for every other adjacent group. The pair of housings 211 have the identical shape and are connected such that the intermediate portions 214 mutually engage with each other. Also, reference numeral 218 designates a clearance formed between the mutual intermediate portions 214. With the clearance, the connector 201 can be distorted in the width direction (transverse direction in FIGS. 10 and 13). Accordingly, when the two connected housings 211 are displaced from each other in mutually different width directions, for instance, in the right and left directions in FIGS. 10 and 13, the connector 201 is prevented from being damaged.

In addition, the terminals 251 extend in the connection direction of the flat cable 301, are made of an elastic conductive material like metal such as phosphor bronze, and has an axisymmetric shape with respect to the straight line perpendicular to the connection direction in the center of the connection direction of the connector 201, that is, a shape symmetrical with respect to the right and left in FIG. 14. The terminal 251 includes a connecting portion 252 for connecting, in the center, right and left portions of the terminal 251, base portions 253 connected to respective ends of the connecting portion 252, inclined portions 254 connected to the ends of the base portions 253, and end portions 255 as contact portions connected to the ends of the inclined portions 254. It is to be noted that the connecting portion 252 is positioned above the intermediate portion 214, and the base portion 253, the inclined portion 254, and the end portion 255 are positioned below the base plate portion 212. In this case, the base portion 253 passes through a through-hole 214*a* provided in the joining portion connecting the intermediate portion 214 and the base plate portion 212 together.

A plurality of terminal accommodating grooves 215 are formed in the lower surface of the base plate portion 212 parallel to each other, extending in the connection direction of the flat cable 301, and the right and left base portions 253 of the terminals 251 are fitted in the right and left terminal accommodating grooves 215 of the base plate portions 212 and held therein. In this state, the base portions 253 extend in parallel with the lower surface of the base plate portion 212, the inclined portions 254 are inclined with respect to the lower surface of the base plate portion 212 so that the inclined portion 254 descend more as the positions thereof change toward the ends thereof, and the end portions 255 are curved so that they bulge downward and the ends thereof face upward. In other words, the inclined portions 254 of the terminals 251 are formed in the shape of a cantilever-like shape with the roots of the inclined portions 254 connected to the base portion 253 which are fixed to the base plate portions 212, and the end portions 255 positioned at the free ends are disposed largely away from the lower surface of the base plate portion 212. It is to be noted that the end portions 255 are disposed at the positions corresponding to the thick portions 213 of the base plate portions 212. The number and the pitch of the terminals 251 can be appropriately changed according to the number and the pitch of conductive wires 351 of the flat cable 301 which will be described later.

In addition, the housing 211 includes a plurality of hook members 231. The hook members 231 project downward from the base plate portion 212, are members for engaging with engaging holes 312 formed in the flat cable 301, which will be described later, and are integrally formed with the base plate portion 212. In the illustrated embodiment, each of the hook members 231 is a plate-like member having an approximately rectangular shape extending in the connection direction of the flat cable 301 and in the direction perpendicular to the base plate portion 212.

In the second embodiment of the present invention, the terminals 251 are arranged in a plurality of groups each consisting of the predetermined number of, for instance, twenty-five, terminals 251, and the hook members 231 are disposed between the adjacent groups of the terminals 251. That is, the hook members 231 are disposed at the positions corresponding to the thick portions 213 of the base plate portions 212, similar to the end portions 255 of the terminals 251, and are disposed side by side alternately with the groups of the end portions 255 to form a row extending in the width direction of the connector 201.

An engaging projection 232, which projects in the direction facing the side opposite to the center of the connector 201, that is, in the direction facing the side opposite to the leading end of each flat cable 301 to be connected thereto, are integrally formed in the lower end of the each hook member 231. The engaging projections 232 engage with the lower surface of the flat cable 301 to regulate downward displacement of the flat cable 301 and prevent the engagement of the engaging holes 312 and the hook members 231 from being canceled. On the other hand, in the state in which the engaging holes 312 and the hook members 231 are engaged, since the flat cable 301 upwardly pushes the leading end portions 255 of the terminals 251 positioned between the adjacent hook members 231, the flat cable 301 will be subjected to a downward reaction force from the terminals 251. Therefore, the flat cable 301 will be in the state of being sandwiched and held from above and below by engaging projections 232 of the hook members 231 and the end portions 255 of the terminals 251, and thus the connection state of the flat cable 301 to the connector 201 will be maintained.

In this case, each of the hook members 231 exists over the range including the position of the end portion 255 of the terminal 251 with respect to the connection direction of the flat cable 301, in other words, the insertion direction of the housing 11. For this reason, the distance in the connection direction of the flat cable 301 between the point of action of the downward force which the flat cable 301 receives from the end portions 255 of the terminals 251 and the point of action of the upward force which the flat cable 301 receives from the engaging projections 232 of the hook members 231 can be approximated to zero. That is, the flat cable 301 is pinched by receiving the upward and downward forces applied from the terminals 251 and the hook members 231 at approximately the same region in the connection direction of the flat cable 301. Accordingly, the flat cable 301 will be stably sandwiched and held without being deformed.

Further, a cable engagement projection piece 216, which projects in the direction facing the side the opposite to the leading end of each flat cable 301, is integrally formed with the joining portion of the intermediate portion 214 and the base plate portion 212. The leading end of the flat cable 301 is inserted between the lower surface of the base plate portion 212 and the upper surface of the cable engagement projection piece 216 to be held therein.

Next, the operation of connecting the flat cable 301 to the connector 201 will be explained.

Figure 15:
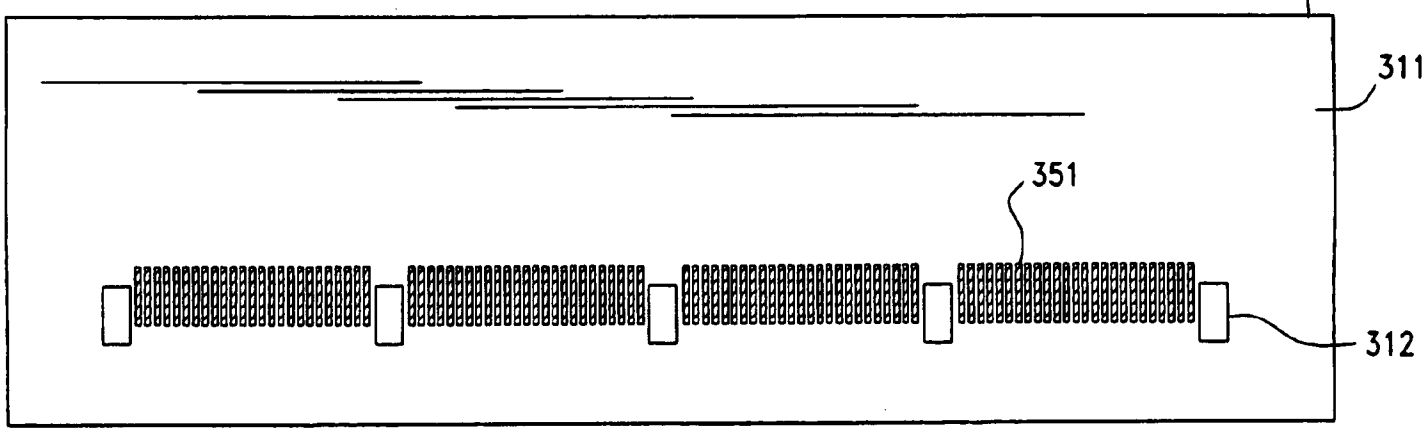
FIG. 15 is a plan view of the flat cable according to the second embodiment of the present invention.
Figure 16:
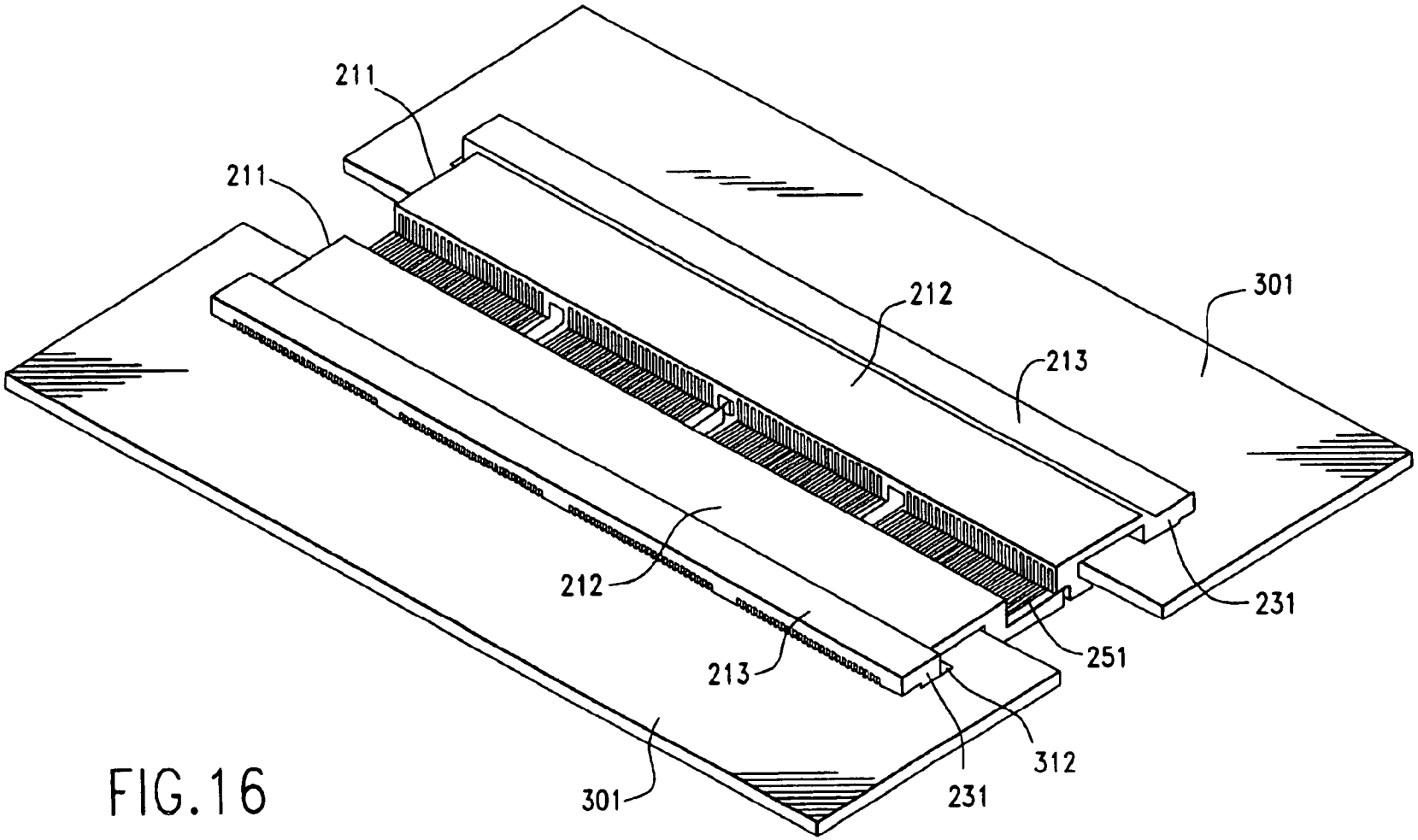
FIG. 16 is a perspective view of the connector according to the second embodiment of the present invention, in the state in which the flat cables are connected thereto.
Figure 17:
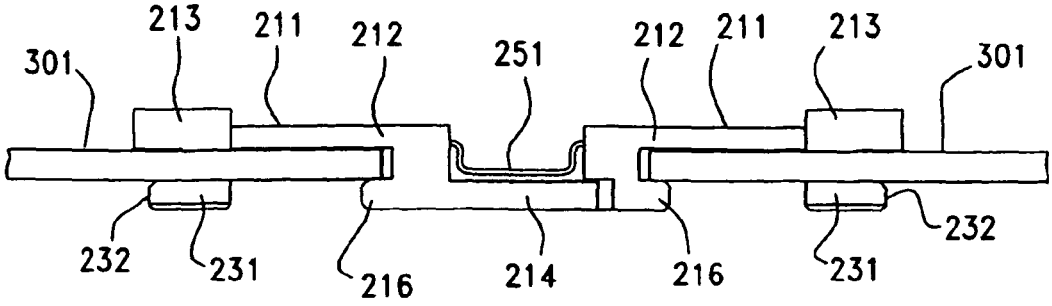
FIG. 17 is a front view of the connector according to the second embodiment of the present invention, in the state in which the flat cables are connected thereto.
Figure 18:
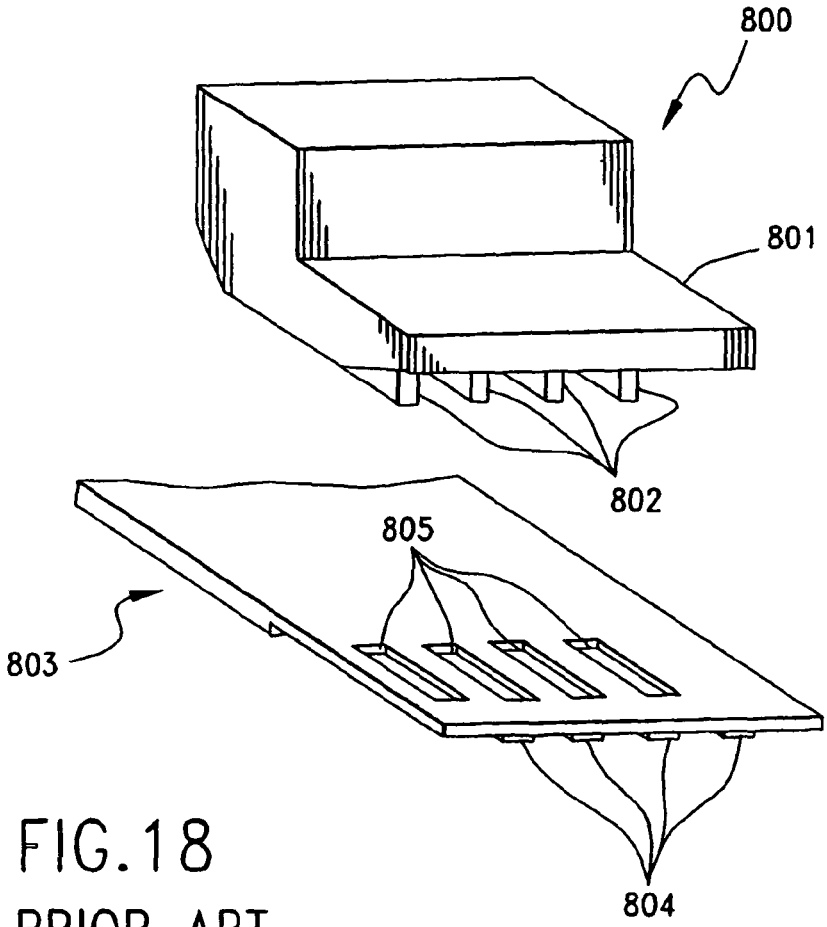
FIG.18 PRIOR ART
FIG. 18 is a perspective view of a conventional connector.

FIG. 15 is a plan view of a flat cable according to the second embodiment of the present invention. FIG. 16 is a perspective view of the connector according to the second embodiment of the present invention, in the state in which the flat cables are connected thereto. FIG. 17 is a front view of the connector according to the second embodiment of the present invention, in the state in which the flat cables are connected thereto.

As illustrated in FIG. 15, the flat cable 301 includes a base plate portion 311 which is an insulating thin-plate member having an elongated and thin strip-like shape, and a plurality of conductive wires 351 disposed in one surface of the base plate portion 311, that is, the upper surface thereof. It is to be noted that in FIG. 15, for convenience for illustration, only a portion of the flat cable 301 near the leading end thereof is illustrated as a transversely elongated rectangle, however, the flat cable 301 is a member which extends in the vertical direction in FIG. 15 and the conductive wires 351 also extend in the vertical direction in FIG. 15. In addition, the leading end of the flat cable 301 corresponds to the lower end in FIG. 15. And the conductive wires 351 are foil-like linear objects made of conductive metal such as copper, for instance, and are disposed in parallel at a predetermined pitch. It is to be noted that the number and the pitch of the conductive wires 351 can be appropriately changed, if necessary.

In addition, the upper surfaces of the conductive wires 351 are covered by an insulating protective film, however, as illustrated in FIG. 15, the protective film is removed only in the predetermined area adjacent to the leading end of the flat cable 301 and the conductive wires 531 are exposed.

As illustrated in FIG. 15, the slit-like engaging holes 312 extending in the longitudinal direction of the flat cable 301, that is, in the connection direction of the flat cable 301, are formed in the base plate portion 311 in the predetermined area so as to extend through the base plate portion 311 in the thickness direction. In the illustrated embodiment, each of the engaging holes 312 is an approximately rectangular opening, with the width approximately corresponding to the thickness of the hook member 231 and the length approximately corresponding to the dimension of the hook member 231 in the connection direction of the flat cable 301 (dimension in the transverse direction in FIG. 14). It is to be noted that the length of the engaging hole 312 is preferably equal to the dimension of the lower end of the hook member 231 in the connection direction of the flat cable 301, that is, the dimension corresponding to the sum of the body portion of the hook member 231 and the engaging projection 232 in the connection direction of the flat cable 301.

In the second embodiment of the present invention, the conductive wires 351 are arranged to form groups each consisting of a predetermined number of, for instance, twenty-five, conductive wires 351, and the engaging holes 312 are disposed between the adjacent groups of the conductive wires 351, side by side alternately with the groups of the conductive wires 351 to form a row extending in the width direction of the flat cable 301 (transverse direction in FIG. 15).

Incidentally, when a base plate portion without flexibility is used, the number of conductive wires in one group of the conductive wires 351 may be increased compared to the case when a flexible cable is used.

That is, in the case of a flexible cable, if the number of conductive wires for every one group is increased, a middle portion of the group is bent due to the elastic force of the terminals and there is a possibility that the contact between the conductive wires and the terminals becomes unstable, however, in the case of a base plate without flexibility, a middle portion of the group may not be easily bent and the contact between the conductive wires and the terminals becomes stable.

In the case of connecting the flat cable 301 to the connector 201, first, the flat cable 301 is positioned such that the exposed conductive wires 351 face the lower surface of the base plate portion 212 and the direction along which the conductive wires 351 extend matches the direction along which the terminals 251 extend.

For instance, in FIGS. 16 and 17, the flat cable 301 to be connected to the right side portion of the connector 201 is positioned below the terminals 251 on the right side such that the longitudinal direction of the flat cable 301 corresponds to the transverse direction, the leading end thereof faces to the left, and each of the engaging holes 312 is positioned immediately below each of the corresponding hook members 231 of the housing 211. In addition, for instance, in FIGS. 16 and 17, the flat cable 301 to be connected to the left side portion of the connector 201 is positioned below the terminals 251 on the left side such that the longitudinal direction of the flat cable 301 corresponds to the transverse direction, the leading end thereof faces to the right, and each of the engaging holes 312 is positioned immediately below each of the corresponding hook members 231 of the housing 211.

Subsequently, the hook member 231 is inserted in the corresponding engaging hole 312 by moving the flat cable 301 upward so as to be engaged therewith. In this case, since the engaging hole 312 is disposed in the position between the adjacent groups of the conductive wires 351, and the hook member 231 is disposed in the position between the adjacent groups of the end portions 255 of the adjacent terminals 251, the positioning of each conductive wire 351 of the flat cable 301 and the end portion 255 of each terminal 251 will be automatically performed, by bringing the engaging hole 312 into engagement with the hook member 231.

In addition, the flat cable 301 is moved upward so that the engaging holes 312 are inserted over the hook members 231 to engage with the hook members 231, the conductive wires 351 which are exposed to the upper surface of the flat cable 301 are brought into contact with the end portions 255 of the terminals 251 and end portions 255 are raised upward. Here, since the terminals 251 are made of a flexible material, the terminals 251 are resiliently displaced by being pressed upward by the conductive wires 351. In this state, the end portions 255 are pressed against the conductive wires 351 by a downward urging force occurring due to elasticity of the terminals 251 themselves. Therefore, the flat cable 301 receives, from the end portion 255, the downward urging force occurring due to elasticity of the terminals 251 themselves, that is, the reaction force of the terminals 251.

When the height of the lower surface of the flat cable 301 becomes equal to the height of the upper surface of the engaging projection 232 of the hook member 231, the flat cable 301 is moved in the connection direction, that is, toward the center of the housing 211. Then, the engaging projection 232 projecting in the lower end of the hook member 231 in the direction facing the side opposite to the center of the housing 211 engage with the lower surface of the flat cable 301. Therefore, the downward displacement of the flat cable 301 is regulated by the engaging projections 232 and the engaging state of the engaging holes 312 and the hook members 231 is prevented from being canceled. In addition, the leading end of the flat cable 301 is fit between the lower surface of the base plate portion 212 and the upper surface of the cable engagement projection piece 216 and held therein.

Thereby, the flat cable 301 becomes in the state in which it is sandwiched and held from above and below by the engaging projections 232 of the hook members 231 and the end portions 255 of the terminals 251. In this case, the end portion 255 of each terminal 251 is pressed against the corresponding conductive wire 351 due to elasticity of the terminal 251 itself, and is electrically connected to the conductive wire 351. Accordingly, the flat cable 301 becomes in the state in which it is connected to the connector 201. As described above, since the flat cable 301 receives the downward reaction force occurring due to elasticity of the terminals 251 themselves, the flat cable 301 is in the state in which it is sandwiched and held by the engaging projections 232 of the hook members 231 and the tip portions 255 of the terminals 251. Further, the leading end of the flat cable 301 is held by the base plate portion 212 and the cable engagement projection piece 216. Therefore, the connecting state of the flat cable 301 to the connector 201 is maintained.

As described above, in the second embodiment, the flat cable 301 is sandwiched and held by the hook members 231 and the terminals 251 so as to maintain the connecting state of the flat cable 301 to the connector 201. As a result, despite the simple structure of the connector, the connector 201 can be easily and surely connected to the flat cable 301.

In addition, since the flat cable 301 is sandwiched and held by the hook members 231 and the terminals 251 which are arranged side by side in the width direction of the connector 201, a force occurring by sandwiching the flat cable 301 may not be concentrated on or applied to the center of the housing 211 in the width direction, and therefore the housing 211 can be prevented from being deformed. As a result, the multipolarized connector 201 which corresponds to the flat cable 301 including a number of conductive wires 351 can be provided.

Further, each of the hook members 231 exists over the range including the position of the end portion 255 of the terminal 251 in the connection direction of the flat cable 301. Therefore, the flat cable 301 is sandwiched and held by being subjected to the upward and downward forces from the terminals 251 and the hook members 231, at approximately the same region with respect to the connection direction of the flat cable 301. As a result, the flat cable 301 can be stably sandwiched and held without being deformed.

Further, in the second embodiment, since it is not necessary to use an actuator, the structure of the connector 201 can be simplified. In addition, since the hook members 231 are disposed so as to be positioned between the adjacent groups of the terminals 251, the number of the hook members 231 can be reduced and, as a result, the structure of the connector 201 can be simplified.

The present invention is not limited to the above-described embodiments, and may be changed in various ways based on the gist of the present invention, and these changes are not eliminated from the scope of the present invention.

What is claimed is:

1. A connector comprising:

a housing, the housing including a base plate portion facing one surface of a pair of flat cables; and a plurality of terminals, each terminal adapted for contacting conductive wires of the flat cables;

wherein the base plate portion includes a plurality of hook members, each hook member being disposed between adjacent terminals and adapted for engaging with engaging holes of the flat cables.

2. The connector according to claim 1, wherein:

each terminal includes a base portion fixed to the base plate portion, an inclined portion connected to the base portion and disposed farther away from the base plate portion as a position thereof changes toward a distal end thereof, and a contact portion connected to the inclined portion and brought into contact with the conductive wire of the flat cable;

each terminal applies an urging force to the flat cable connected to the connector in a direction away from the base plate portion; and each hook member engages with the flat cable against the urging force of one of the terminals.

3. The connector according to claim 1, wherein each hook member is disposed between adjacent groups of terminals.

4. The connector according to claim 1, further comprising:

an actuator, the actuator being provided in the housing such that the attitude of the actuator can be changed between a first position in which the flat cable can be inserted and a second position in which the inserted flat cable is covered;

wherein the actuator in the second position prevents the flat cable from moving in a direction away from the base plate portion.

5. A connector comprising:

a housing, the housing including a base plate portion facing one surface of a pair of flat cables; and a plurality of terminals, each terminal extending in a longitudinal direction of the housing, having an approximately axisymmetric shape with respect to a straight line perpendicular to the longitudinal direction in a center thereof in the longitudinal direction, and adapted for contacting conductive wires of the flat cables;

wherein the base plate portion includes a plurality of hook members, each hook member being disposed between adjacent terminals and adapted for engaging with engaging holes of the flat cables.

6. The connector according to claim 5, wherein:

each terminal includes a base portion fixed to the base plate portion, an inclined portion connected to the base portion and disposed farther away from the base plate portion as a position thereof changes toward a distal end thereof, and a contact portion connected to the inclined portion and brought into contact with the conductive wire of the flat cable;

each terminal applies an urging force to the flat cable connected to the connector in a direction away from the base plate portion; and each hook member engages with the flat cable against the urging force of one of the terminals.

7. The connector according to claim 5, further comprising:

an actuator, the actuator being provided in the housing such that the attitude of the actuator can be changed between a first position in which the flat cable can be inserted and a second position in which the inserted flat cable is covered;

wherein the actuator in the second position prevents the flat cable from moving in a direction away from the base plate portion.

8. The connector according to claim 5, wherein each hook member is disposed between adjacent groups of terminals.

9. A connector for connecting together two ends of flexible printed circuitry, the connector comprising:

a housing, the housing including:

a base portion, a pair of sidewalls extending along opposite sides of the base portion, the sidewalls collectively defining an accommodating space extending longitudinally through the housing for receiving two ends of opposing lengths of flexible printed circuitry, and a plurality of upstanding hook members for engaging openings formed in the ends of the flexible printed circuitry lengths, each hook member being spaced apart from each other widthwise adjacent the sidewalls and including engaging projections at an upper end, the engaging projections extending lengthwise within the accommodating space; and a plurality of conductive terminals supported in the accommodating space, each terminal including a flat base portion with two free ends extending outwardly and upwardly therefrom at an angle thereto, each free end terminating in a contact portion, each contact portion being disposed between adjacent hook members in the accommodating space and within the lengthwise extent of the engaging projections.

10. The connector of claim 9, further including a terminal support member disposed in the accommodating space, the terminal support member supporting the terminals along the terminal base portions.

11. The connector of claim 9, further including a pair of actuators moveably mounted to the housing, each actuator being moveable between first and second operative positions.

12. The connector of claim 11, wherein:

in the first operative position, each actuator projects partially out of the accommodating space; and in the second operative position, each actuator extends within the accommodating space and contacts the lengths of the flexible printed circuitry so as to press them against the terminal contact portions.

13. The connector of claim 12, wherein each actuator includes a shaft received within the housing sidewalls.

14. The connector of claim 12, wherein each actuator includes lock projections, each lock projection engaging the housing sidewalls to lock each actuator in the second operative position.

15. The connector of claim 12, wherein each actuator includes a plurality of recesses formed therein, each recess accommodating ends of the hook members therein.

* * * * *